US005553529A

United States Patent [19]

Smith

[11] Patent Number: 5,553,529

[45] Date of Patent: Sep. 10, 1996

[54] THUMBREST RING ADAPTER FOR MUSICAL INSTRUMENT

[76] Inventor: Leland B. Smith, 8278 E. Hinsdale Ave., Englewood, Colo. 80112

[21] Appl. No.: 413,386

[22] Filed: Mar. 30, 1995

Related U.S. Application Data

[63] Continuation-in-part of Ser. No. 378,198, Jan. 25, 1995.

[51] Int. Cl.[6] ..... G10D 7/10; G10D 7/08

[52] U.S. Cl. ..... 84/453; 84/387 A; 84/385 A; 224/910

[58] Field of Search ..... 84/387 A, 453, 84/327, 379, 385 A, 376 A; 224/910

[56] References Cited

U.S. PATENT DOCUMENTS

| | | | |
|---|---|---|---|
| 2,498,459 | 2/1950 | Schroetter | 84/280 |
| 2,861,767 | 11/1958 | Oves et al. | 248/356 |
| 3,024,690 | 3/1962 | Sanstead | 84/387 |
| 3,129,863 | 4/1964 | Haugen et al. | 84/385 A |
| 3,192,817 | 7/1965 | Schmidt | 84/327 |
| 3,266,766 | 8/1966 | Linville | 248/359 |
| 3,811,357 | 5/1974 | Stewart | 84/327 |
| 4,841,829 | 6/1989 | Lehmann | 84/385 |

*Primary Examiner*—Cassandra C. Spyrou

*Attorney, Agent, or Firm*—John B. Phillips; John R. Ley

[57] ABSTRACT

A ring adapter assembly is releasably attachable to a thumbrest of a woodwind musical instrument, such as an oboe, clarinet, English horn or straight saxophone, to provide an attachment ring in those instances when the thumbrest of the instrument does not include a permanent attachment ring. The ring adapter assembly allows a support device to be attached to the musical instrument to relieve the weight on the thumb and hand of a musician playing the instrument. One embodiment of the ring adapter assembly is used with fixed position thumbrests and is adapted to be seated on a top surface of the thumbrest so that an attachment ring within the assembly faces away from the musical instrument. A top portion of the assembly may be moved up and down by an adjustment screw and includes a spring wire which extends around the thumbrest to connect the assembly to the thumbrest. Upward adjustment of the top portion increases the tension on the wire and the downforce applied to the assembly to maintain the assembly seated on the thumbrest. Another embodiment of the ring adapter assembly fixes an attachment ring to an adjustable thumbrest. The position of the ring adapter assembly on the thumbrest is adjustable to compensate for adjustments of the thumbrest in relation to the musical instrument. An attachment component for a monopod strut device is also disclosed. The attachment component is releasably attachable to the ring adapter assembly to support the musical instrument.

16 Claims, 8 Drawing Sheets

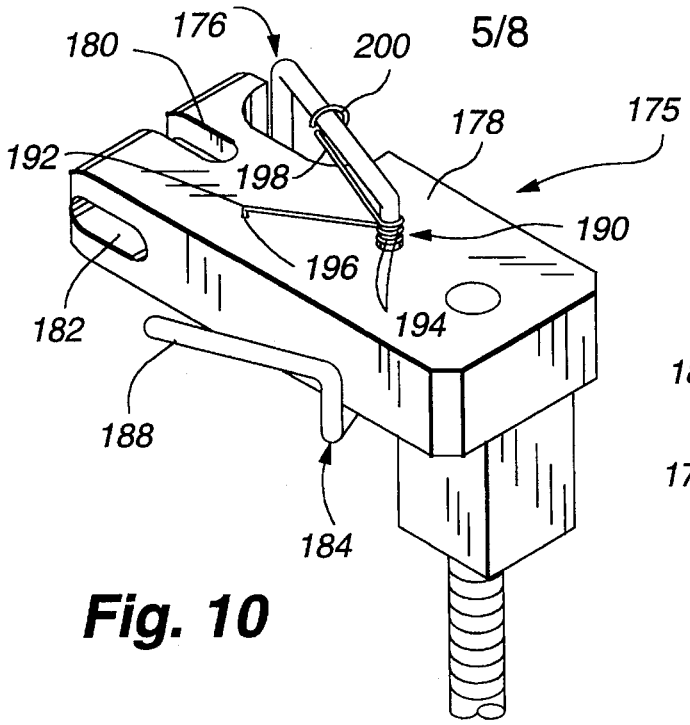
Fig. 10
Fig. 11
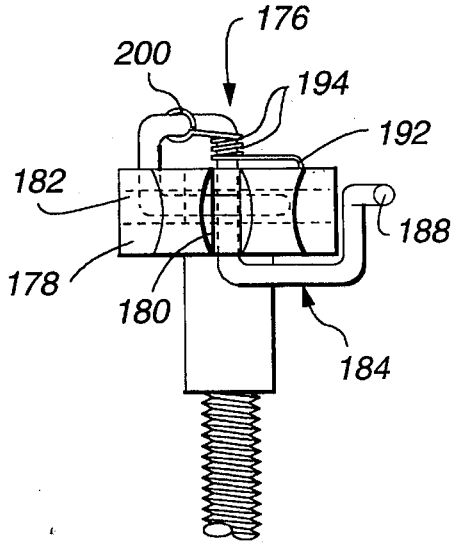
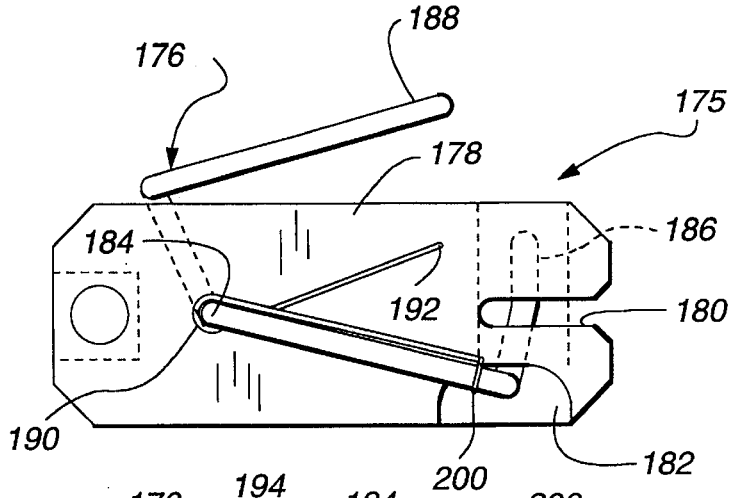
Fig. 12
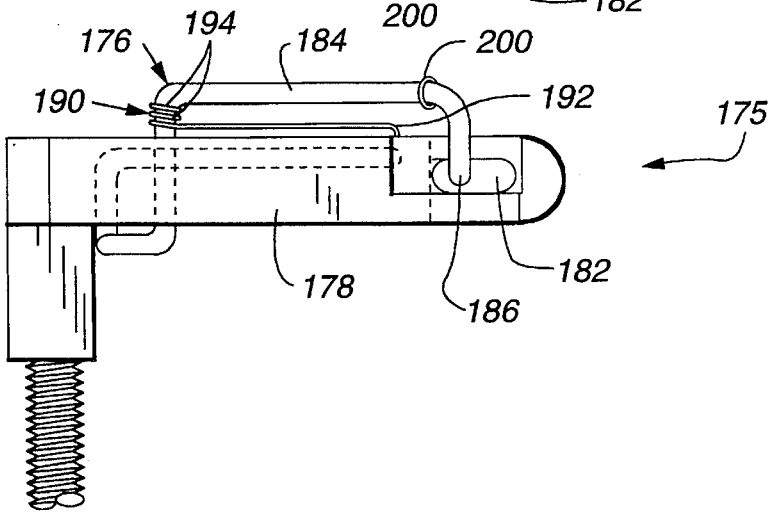
Fig. 13

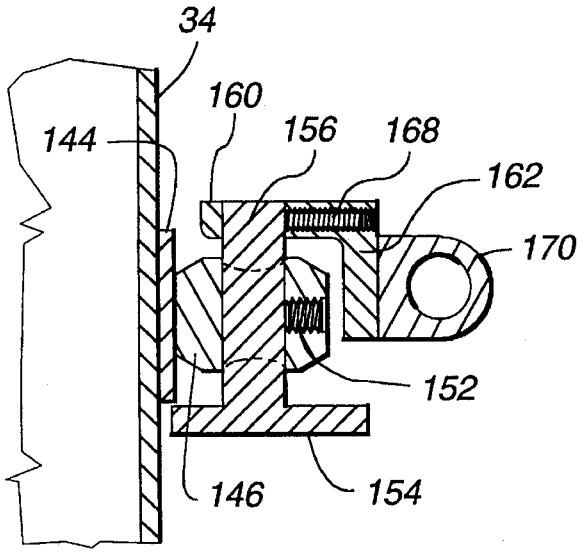
Fig. 17
Fig. 18
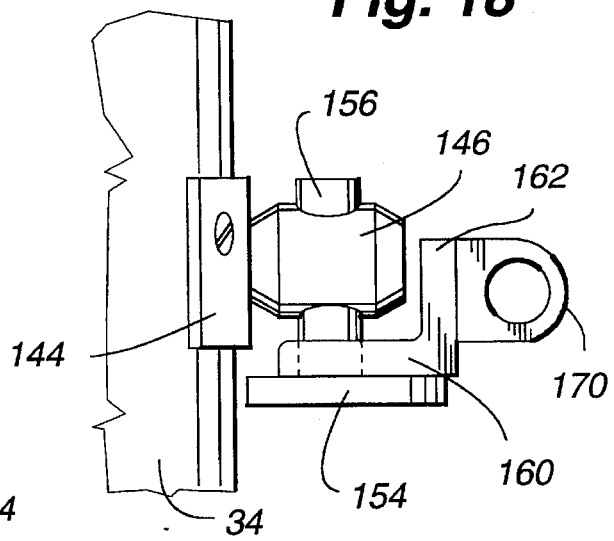
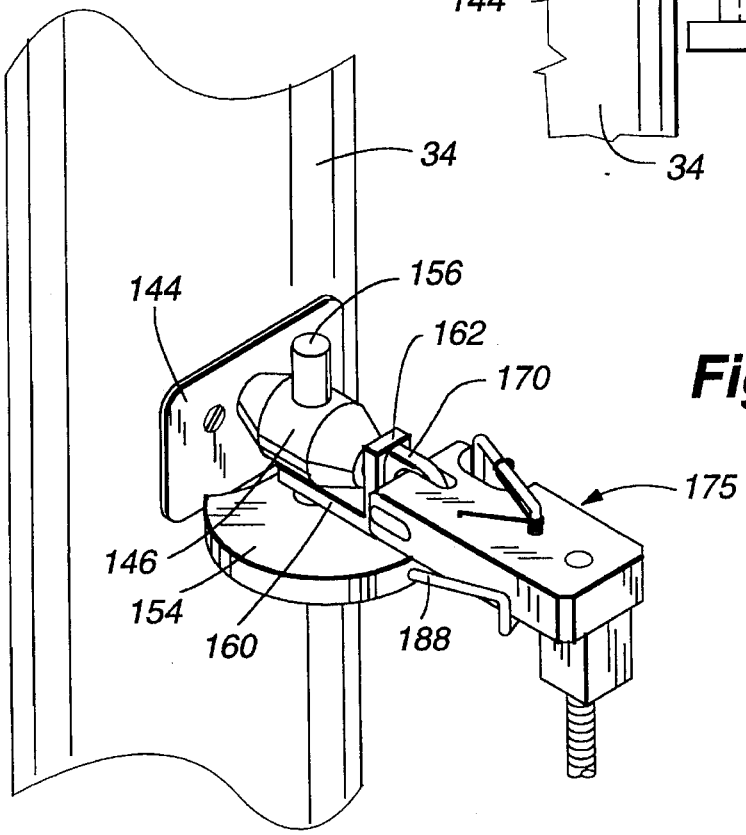
Fig. 19

THUMBREST RING ADAPTER FOR MUSICAL INSTRUMENT

CROSS REFERENCE TO RELATED APPLICATION

This is a continuation-in-part of U.S. patent application Ser. No. 08/378,198 for "Extendable Monopod Strut Device For Musical Instrument," filed Jan. 25, 1995, currently pending. The disclosure of the parent application is incorporated herein by this reference.

FIELD OF THE INVENTION

This invention relates to musical instruments of the type which are substantially supported by a thumb or hand of the musician while they are being played, such as an oboe, clarinet, English horn or straight saxophone. More particularly, the present invention relates to a new and improved apparatus for selectively connecting an attachment ring to either a fixed or an adjustable thumbrest of a musical instrument which did not previously provide an attachment ring. The attachment ring may be used to attach a support device such as a neck strap or a monopod support of the type described in the aforementioned application to the musical instrument to relieve the musician of some of the fatigue involved when playing the instrument.

BACKGROUND OF THE INVENTION

Certain reed woodwind musical instruments, such as the oboe, the clarinet, the English horn and the straight saxophone, require the musician to hold the instrument by the musician's mouth embouchure and by the musician's hands, while simultaneously requiring the embouchure to be flexible enough to achieve the desired range of reed vibration and requiring the fingers to be flexible and moveable enough to depress all of the keys when playing the instrument. One consequence of these requirements for simultaneous stability and flexibility is that the support arrangement for the instrument can not limit the flexibility of the musician's fingers or mouth. As a result, an oboe, clarinet, English horn and straight saxophone all include a thumbrest which rests on the thumb of the musician's right hand. The thumbrest itself typically comprises a flange which protrudes from the musical instrument, the flange having a flat underside that is supported on the musician's right thumb while the remaining fingers of the right hand are unrestricted to contact the key pads of the instrument. The thumbrest may be fixed in position on the musical instrument or it may be adjusted over a narrow range of positions along the length of the instrument. The fingers and the thumb of the musician's left hand are all available to contact key pads.

The substantial majority of the weight of the instrument is supported by the thumb of the musician's right hand, since the embouchure can not support the weight of the instrument and still remain flexible enough to play the instrument, and because the fingers of the left hand must remain free to contact the keypads. As a result, considerable strain in the hand and on the right thumb may be experienced by the musician during prolonged musical performances or practice sessions. For professional and student musicians, the strain may become so unbearable as to hinder their ability to play the instrument. Worse still, repeated strain may cause severe and permanent injuries of a nature similar to repetitive motion injuries.

A variety of instrument support devices have been created to relieve the musician of the stress involved with supporting the musical instrument over a prolonged period of time. These devices include both conventional neck straps and chest support devices which are typically connected to an attachment ring mounted on a top side of the thumbrest opposite the underside where the musician's right thumb is placed. In addition to neck straps and chest supports, the attachment ring may also be connected to a monopod support such as the one described in U.S. patent application Ser. No. 08/378,198 for "Extendable Monopod Strut Device For Musical Instrument," filed Jan. 25, 1995.

However, not all woodwind musical instruments include an attachment ring on top of the thumbrest. In particular, clarinets and less expensive oboes often do not include such an attachment ring on the thumbrest. In these instances, a neck strap, a chest support or a monopod support can not be directly attached to the thumbrest, and the weight of the musical instrument must be fully supported by the musician's thumb and embouchure.

Alternatively, a different means of supporting the musical instrument which is not dependent on a thumbrest attachment ring may be utilized. Such alternative means includes wrist straps which extend from the musician's wrist, between the thumb and forefinger, to the instrument at a location near a bell of the instrument. The lower end of the strap is attached by a belt which is attached around the body of the instrument. The length of the strap is adjusted to position the hand in the desired location and to relieve the weight on the thumb. Wrist support devices of this type have not achieved acceptance, possibly due to the constriction on the hand between the thumb and the forefinger and possibly due to the different feel of the instrument when it is supported near its bell rather than in the middle near its center of balance.

A variety of other types of instrument support devices have been used with heavier instruments such as baritones, sousaphones and S-shaped saxophones. However, these other types of support devices are virtually required because of the considerably greater weight of those instruments and would not typically be effective with the smaller woodwind instruments which require a greater degree of dexterity. Thus, in spite of the variety of different types of support devices for a wide variety of different musical instruments, musicians playing the smaller woodwind instruments such as the oboe, the clarinet, the English horn and the straight saxophone typically choose to either support the entire weight of the instrument on their thumb or use a support device connected to an attachment ring on the thumbrest. In those instances where the instrument does not include an attachment ring on the thumbrest, the musician will typically be required to hold the entire weight of the instrument rather than opt for an alternative support device. It is with respect to these and other considerations that the present invention has evolved.

SUMMARY OF THE INVENTION

The present invention provides the capability of attaching a support device, such as a neck strap, chest support or monopod device to a woodwind instrument such as the oboe, the clarinet, the English horn or the straight saxophone when those instruments do not include a permanent eye or attachment ring on the their respective thumbrests. The ability to add such a support device allows a musician to relieve as much of the weight of the musical instrument on the musician's thumb and hand as desired without limiting the position, flexibility or maneuverability of the instrument. A further objective of the present invention is to provide an assembly that allows for the attachment of a support device, where the assembly is relatively small with respect to the size of the musical instrument and where the assembly may be quickly and simply attached to the instrument.

In accordance with the above aspects, the present invention relates to a unique ring adapter assembly which may be releasably attached to a thumbrest on the musical instrument to provide an attachment ring to those thumbrests which do not include their own permanent eye or attachment ring. One embodiment of the ring adapter assembly, which is used with fixed position thumbrests, includes a base adapted to be seated on a top surface of the thumbrest (opposite the bottom surface where the musician's thumb is positioned while playing the instrument). The base holds an attachment ring and fits within an open bottom end of a hollow tube. A cap fits within an open top end of the hollow tube and holds the ring in place within the hollow tube. Once the base is seated on the thumbrest, a spring wire attached to the cap is connected around the thumbrest to maintain the ring adapter assembly attached to the thumbrest. A screw extending through the cap and contacting the base may be rotated to move the cap up and down in relation to the stationary thumbrest. Upward movement of the cap increases tension within the spring wire and tightens the connection of the ring adapter assembly to the thumbrest. A post extending horizontally through the ring adapter assembly supports the spring wire and acts like a fulcrum to direct the force applied by the wire on the ring adapter assembly downward and away from the body of the musical instrument.

An alternative embodiment of the ring adapter assembly is used with thumbrests which are adjustable with respect to the body of the musical instrument. Such adjustable thumbrests typically comprise a horizontal projection with a vertical post fixed to a top side thereof, wherein the musician's thumb typically contacts the bottom side of the horizontal projection. A receptacle fixed to the musical instrument includes a vertical hole to receive the vertical post attached to the horizontal projection. Once the horizontal projection is positioned as desired by the musician, a set screw within the receptacle is tightened about the vertical post to temporarily fix the position of the adjustable thumbrest. The alternative ring adapter assembly includes a an L-shaped body having a horizontal surface with an opening therein to receive the vertical post of the adjustable thumbrest, and having a vertical surface attached to the horizontal surface opposite the opening. An attachment ring or eye is fixed to the vertical surface so that the ring extends away from the musical instrument when the opening in the horizontal surface is placed over the vertical post of the thumbrest. A set screw in the horizontal surface is used to adjustably position the ring adapter assembly on the vertical post of the thumbrest so that the position of the attachment ring relative to the adjustable thumbrest may be adjusted as the position of the thumbrest is adjusted relative to the musical instrument.

The present invention also provides an attachment component for use with the monopod strut device described in the above referenced application. The presently disclosed attachment component is adapted to be releasably attached to both the attachment rings of the ring adapter assemblies described above, as well as the permanent attachment rings disclosed in the above referenced application, without interfering with the conventional placement of the musician's thumb on the thumbrest. The attachment component includes an elongated body with a longitudinal slot formed at one end to receive the attachment ring. A hook is pivotally connected to the elongated body and an actuating handle connected to the hook moves the hook into and out of the attachment ring. Additionally, a transverse slot adjacent the longitudinal slot within the elongated body captures the hook as the hook moves across the longitudinal slot to connect with the attachment ring. Capturing the hook within the transverse slot prevents both upward and downward forces applied to the attachment component from bending or otherwise damaging the hook. The attachment component of the present invention works equally well when the monopod strut device described in the above referenced application is used with the above described ring adapters or with a thumbrest having its own permanent attachment ring.

A more complete appreciation of the present invention and its scope can be obtained from the accompanying drawings which are briefly described below, from the following detailed description of presently preferred embodiments of the invention, and from the appended claims.

BRIEF DESCRIPTION OF THE DRAWINGS

FIG. 10 is a perspective view illustrating an attachment component of a monopod strut device adapted to be releasably connected to the ring adapter assembly shown in FIG. 1.

FIG. 11 is a front elevation view of the attachment component shown in FIG. 10.

FIG. 12 is a top plan view of the attachment component shown in FIG. 10.

FIG. 13 is a side elevation view of the attachment component shown in FIG. 10.

FIG. 17 is a longitudinal section view of the ring adapter assembly and adjustable thumbrest shown in FIG. 15, taken substantially in the plane of line 17—17 in FIG. 15.

FIG. 18 is a side elevation view of the ring adapter assembly and adjustable thumbrest similar to FIG. 16, showing the thumbrest adjusted to an alternative position and showing the ring adapter assembly attached at an alternative location on the adjustable thumbrest.

FIG. 19 is a perspective view of the attachment component shown in FIG. 10 connected to the ring adapter assembly shown in FIG. 18.

DETAILED DESCRIPTION OF PREFERRED EMBODIMENTS

Figure 1:
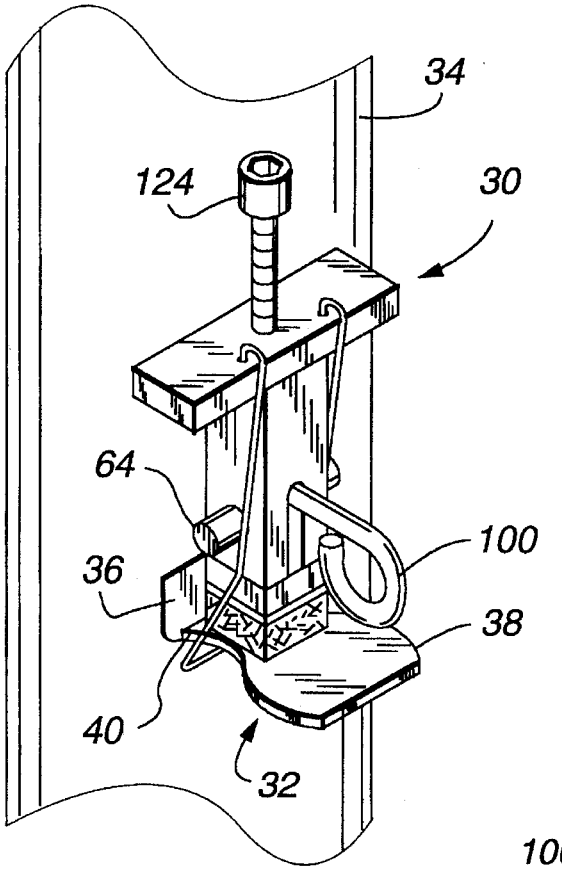
FIG. 1 is a perspective view illustrating a ring adapter assembly embodying the present invention attached to a fixed thumbrest of a musical instrument.
Figure 2:
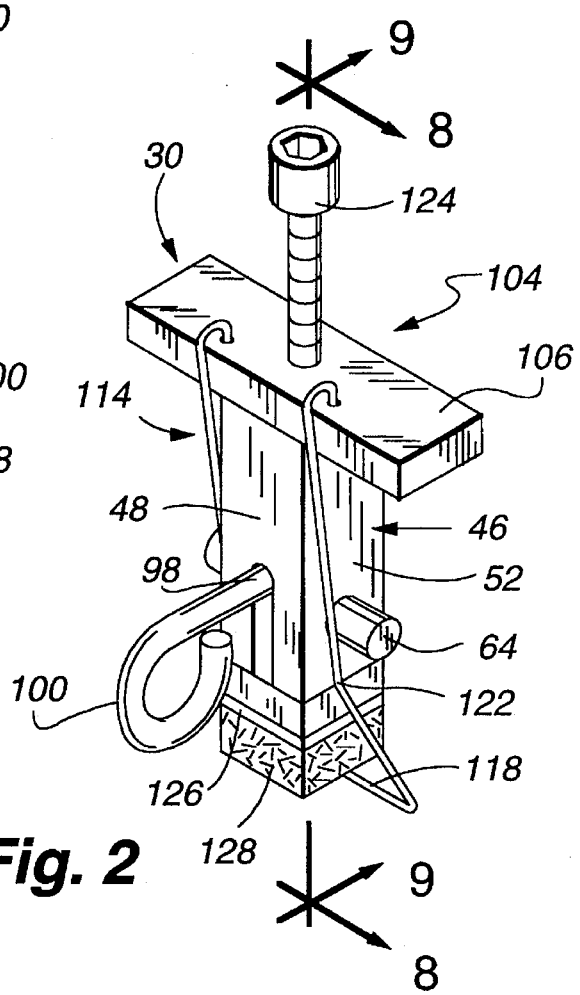
FIG. 2 is an enlarged perspective view of the ring adapter assembly shown in FIG. 1.

A ring adapter assembly 30 for attachment to a fixed position thumbrest 32 of a reed woodwind musical instrument 34, such as an oboe, clarinet, English horn or straight saxophone, is generally illustrated in FIGS. 1 and 2. The fixed position thumbrest 32 is of conventional construction, having a flange 36 which connects to the instrument 34 and a projection 38 which extends generally perpendicularly from the flange 36. A relatively narrow neck portion 40 connects the projection 38 to the flange 36 of the fixed position thumbrest 32. The projection 38 is contacted on a lower surface 42 (FIG. 6) by the thumb of a musician's right hand, as shown in greater detail in U.S. patent application Ser. No. 08/378,198 for "Extendable Monopod Strut Device For Musical Instrument," filed Jan. 25, 1995, the complete disclosure of which is incorporated herein by reference.

The fixed thumbrest 32 typically includes a permanent ring or eye (not shown) attached to the junction of the flange 36 and the projection 38 on top of the neck portion 40. Such a permanent ring or eye would typically be used to attach a conventional support device such as a neck strap to the musical instrument 34. Additionally, a monopod strut device as described in U.S. patent application Ser. No. 08/378,198 may also be attached to such a permanent ring or eye on the fixed thumbrest 32. However, if the musical instrument 34 does not include a permanent ring or eye on the fixed thumbrest 32, as illustrated in FIGS. 1 and 3–6, the ring adapter assembly 30 of the present invention may be releasably attached to the fixed thumbrest 32 to provide a connection point for the neck strap, chest support or monopod strut device.

FIGS. 1 and 3–6 show the attachment of the ring adapter assembly 30 to the fixed thumbrest 32. The ring adapter assembly 30 itself is best shown in FIGS. 2 and 7. The ring adapter assembly 30 preferably includes a hollow main body 46 having a square cross section with a front face 48, a rear face 50 and opposing side faces 52, all of which define an open top end 54 and an open bottom end 56. A slot 58 is formed within the front face 48 midway between the opposing side faces 52, as shown in FIG. 7. The slot 58 preferably extends from the open bottom end 56 to a terminal point 60 positioned approximately midway between the open bottom and top ends 56 and 54, respectively. Additionally, a pair of identical holes 62 are drilled into the opposing side faces 52 as shown in FIG. 7 to allow a cylindrical post 64 to be inserted through the hollow main body 46 between the opposing side faces 52 at a vertical position below the terminal point 60 of the slot 58. The diameter of the cylindrical post 64 is only slightly smaller than the diameter of the holes 62 to provide for a close interference fit when the post 64 is inserted through the holes 62. The hollow main body 46 and the post 64 are preferably constructed from a durable metal or metal alloy such as brass.

A base 68 of the ring adapter assembly 30 also has a square cross section and is divided into an upper base portion 70 with a top surface 72 and a lower base portion 74 with a bottom surface 76. The cross sectional size of the upper base portion 70 is slightly smaller than the size of the open bottom end 56 of the main body 46, thus allowing the upper base portion 70 to fit within the bottom of the hollow main body 46. The cross sectional size of the lower base portion 74 is slightly greater than the size of the open bottom end 56 of the main body 46, thereby creating a circumferential flange 78 which contacts the bottom of the main body 46 when the upper base portion 70 of the base 68 is inserted through the open bottom end 56 of the main body 46 (FIG. 2). The upper base portion 70 includes a front wall 80, a rear wall 82 and opposing side walls 84 corresponding to the front face 48, rear face 50 and opposing side faces 52 of the hollow main body 46.

A top groove 86 is formed in the top surface 72 of the upper base portion 70, as shown in FIG. 7. The top groove 86 extends completely between the front and rear walls 80 and 82, respectively, and is positioned midway between the opposing side walls 84. Similarly, a rear groove 88 is formed in the rear wall 82 of the upper base portion 70. The rear groove 88 extends between the top surface 72 and the flange 78, and is also positioned midway between the opposing side walls 84. Lastly, a hole 90 is formed through the upper base portion 70 between the opposing side walls 84. The hole 90 extends below and intersects a portion of the top groove 86 as shown in FIG. 7, and the position of the hole 90 on each side wall 84 corresponds to the holes 62 in the opposing side faces 52 of the hollow main body 46. The base 68 is preferably made from a durable plastic material such as Delrin™.

A metal ring 94 (also preferably formed from brass) is bent as shown in FIG. 7 to include a rear stem 96, a straight top portion 98 extending substantially perpendicular to the rear stem 96, and a protruding eye portion 100 which extends forward from the straight top portion 98. The rear stem 96 of the ring 94 is sized to fit flush within the rear groove 88 of the upper base portion 70. Similarly, the straight top portion 98 of the ring is sized to fit flush within the top groove 86 of the upper base portion 70 so that the eye portion 100 extends forward of the front wall 80 of the upper base portion 70. Once the ring 94 is fit within the grooves 86 and 88, the upper base portion 70 and ring 94 may be fit within the open bottom end 56 of the hollow main body 46. The flush fit of the ring 94 within the grooves 86 and 88 allows the upper base portion 70 to fit within the main body 46 without interference, and the laterally-centered position of the top groove 86 ensures that the forward protruding eye portion 100 of the ring 94 is received within the slot 58 on the front face 48 of the hollow main body 46 (FIG. 2).

Once the upper base portion 70 is fit entirely within the hollow main body 46 so that the flange 78 created by the interface of the upper and lower base portions 70 and 74, respectively, contacts the bottom of the main body 46, the holes 62 in the side faces 52 of the main body 46 are aligned with the hole 90 extending through the upper base portion 70 between the opposing side walls 84. The cylindrical post 64 may then be inserted through the holes 62 and 90 so that it extends beneath the straight portion 98 of the ring 94 (FIGS.

8 and 9), thereby locking the base 68 into place relative to the main body 46. A liquid cement may be applied to the cylindrical post 64 prior to inserting it through the holes 62 and 90 to prevent the ring adapter assembly 30 from being unintentionally disassembled when the cement hardens. The length of the cylindrical post 64 is greater than the width of the main body 46 so that opposing ends of the post 64 extend beyond the side faces 52 of the main body 46.

A T-shaped cap 104, also preferably made from Delrin™, includes a rectangular top 106 and a downwardly extending leg 108 having a square cross section slightly smaller in dimension than the cross section of the hollow main body 46. A threaded hole 110 (FIG. 7) extends through both the rectangular top 106 and the leg 108 of the T-shaped cap 104. Two smaller non-threaded holes 112 are formed through the rectangular top 106 of the cap 104, one on each side of the downward leg 108, as shown in FIG. 7. The purpose of the holes 110 and 112 is described in detail below. The cross-sectional size of the downward leg 108 allows the leg to fit within the open top end 54 of the main body 46 so that the T-shaped cap may move up and down relative to the main body 46.

Figure 4:
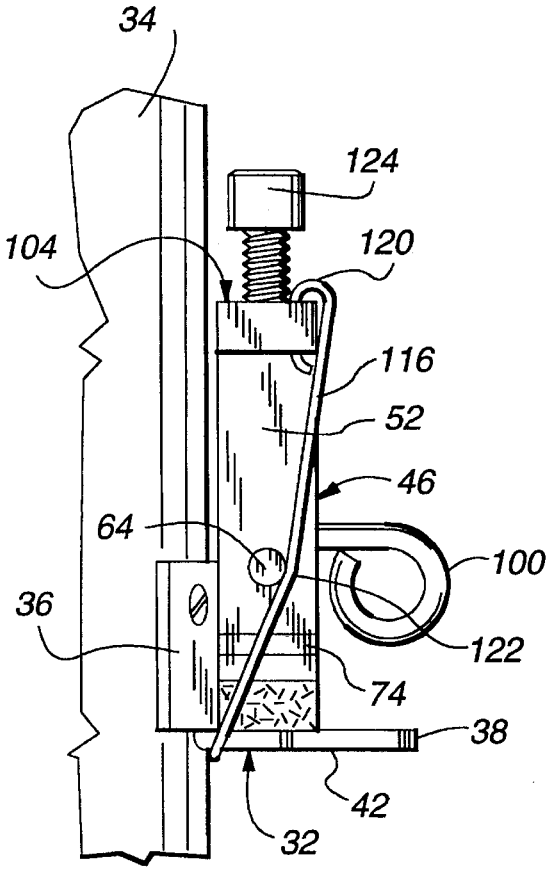
FIG. 4 is a side elevation view of the ring adapter assembly and fixed thumbrest shown in FIG. 1.
Figure 7:
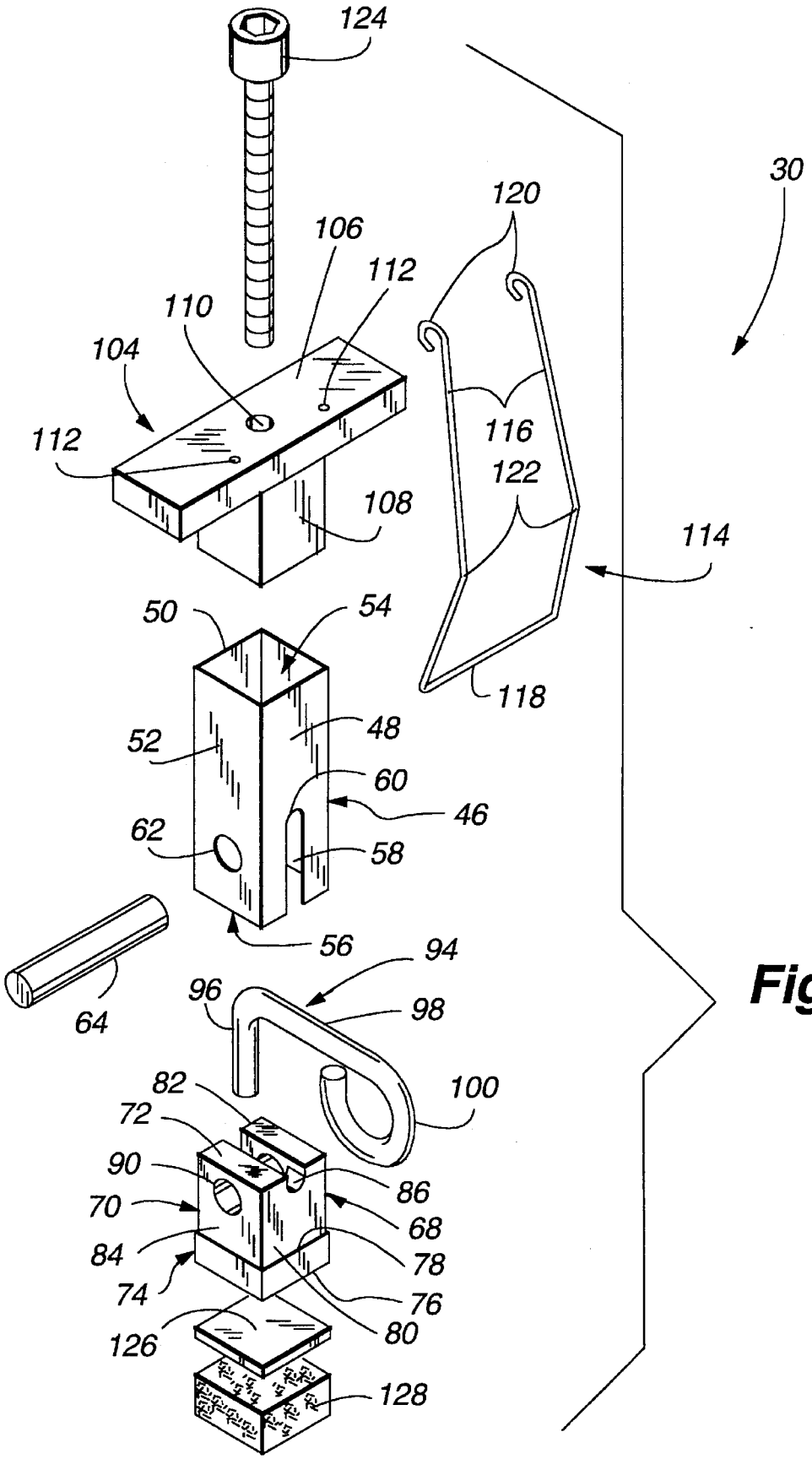
FIG. 7 is an exploded view of the elements of the ring adapter assembly shown in FIG. 2.
Figure 8:
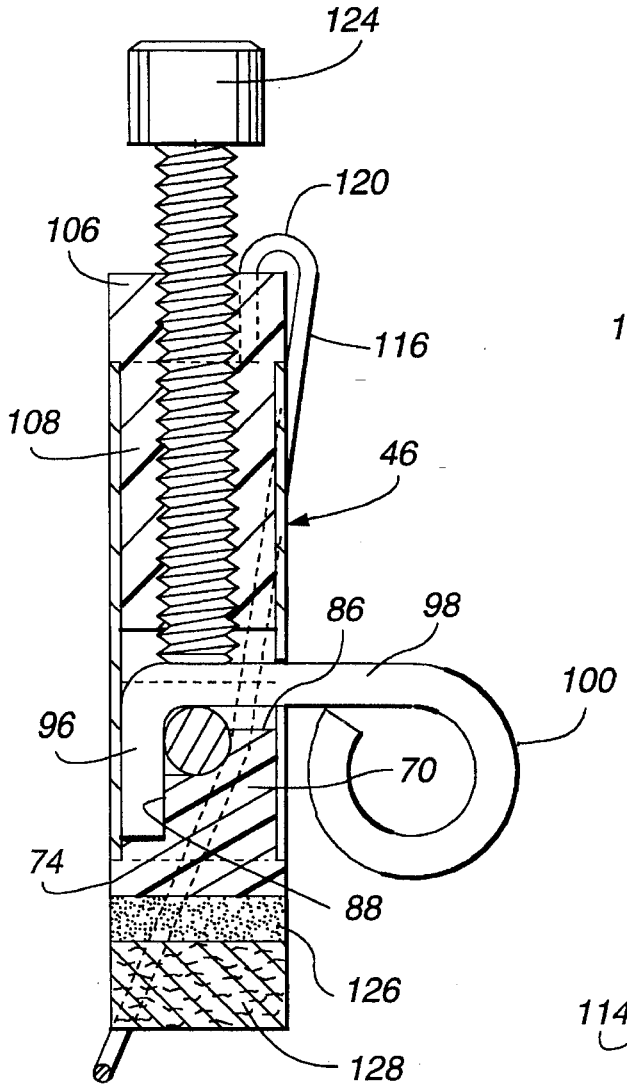
FIG. 8 is a longitudinal section view of the ring adapter assembly, taken substantially in the plane of line 8—8 in FIG. 2.

A spring steel U-shaped wire 114 includes opposing legs 116 and a closed end 118, as shown in FIG. 7. The ends of the opposing legs 116 are each bent to form hooks 120 which are attached within the holes 112 in the rectangular top 106 of the T-shaped cap 104. Additionally, the legs 116 of the U-shaped wire 114 are bent at 122 so that the closed end 118 of the wire extends rearwardly of a centerline of the main body 46 when the leg 108 of the T-shaped cap is inserted within the hollow main body, as shown in FIGS. 2, 4 and 8. The position of the bend 122 in the legs 116 substantially corresponds to the position of the cylindrical post 64 so that the ends of the post 64 contact the U-shaped wire 114 at the point where the closed end 118 extends to the rear of the main body 46, as shown in FIGS. 2, 4 and 8.

Figure 3:
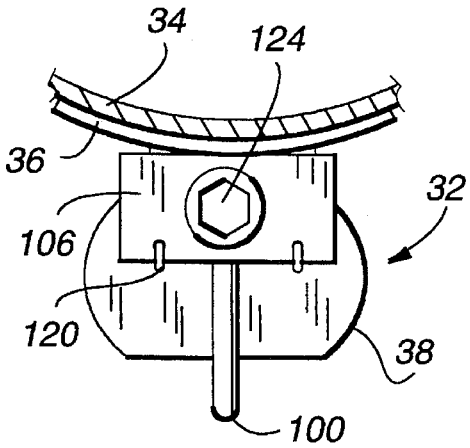
FIG. 3 is a top plan view of the ring adapter assembly and fixed thumbrest shown in FIG. 1.
Figure 5:
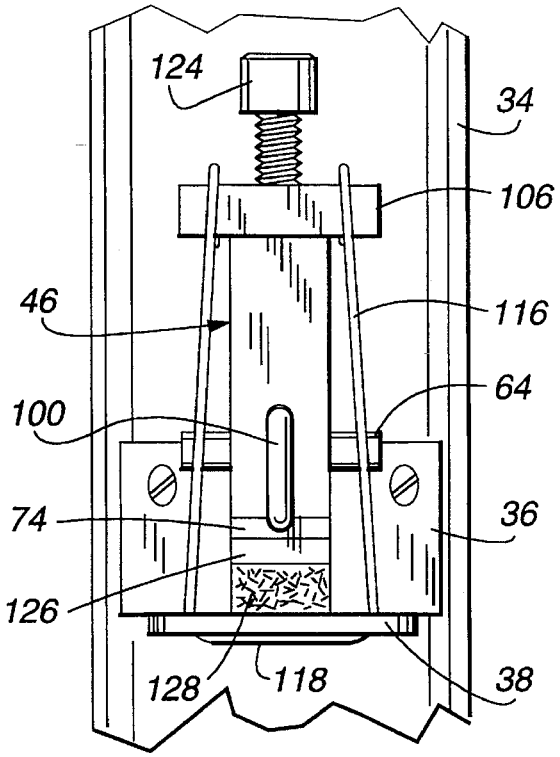
FIG. 5 is a front elevation view of the ring adapter assembly and fixed thumbrest shown in FIG. 1.
Figure 9:
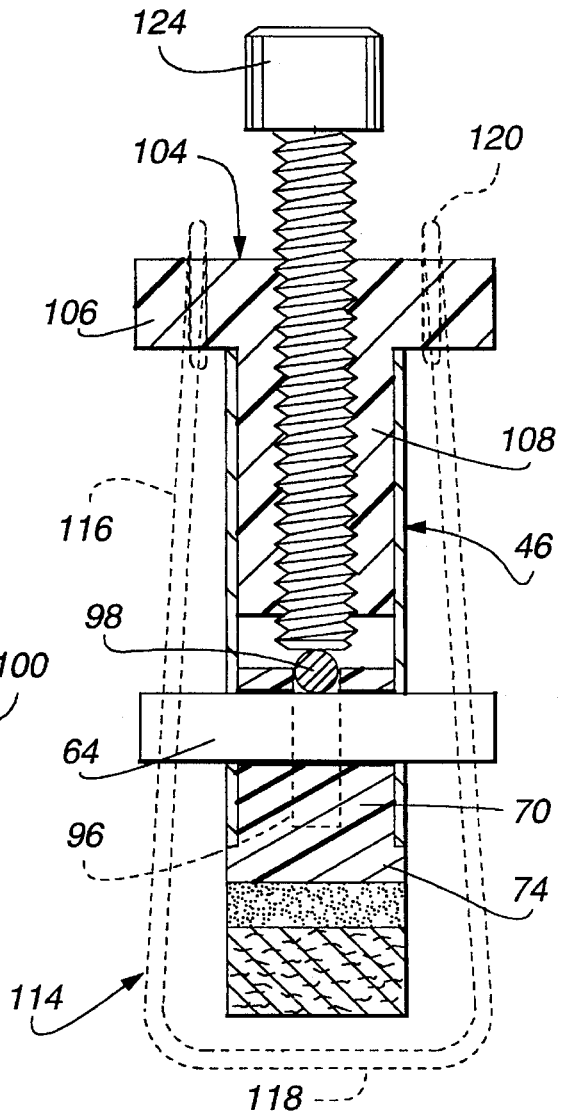
FIG. 9 is a longitudinal section view of the ring adapter assembly, taken substantially in the plane of line 9—9 in 2.

A screw 124 is threaded into the hole 110 so that it extends through both the rectangular top 106 and the leg 108 of the cap 104 in alignment with the ring 94 within the main body 46, as shown in FIGS. 3, 5 and 9. Once the end of the screw 124 contacts the straight top portion 98 of the ring 94 as shown in FIG. 9, the screw may be tightened to raise the T-shaped cap 104 relative to the ring 94 and the main body 46.

Figure 6:
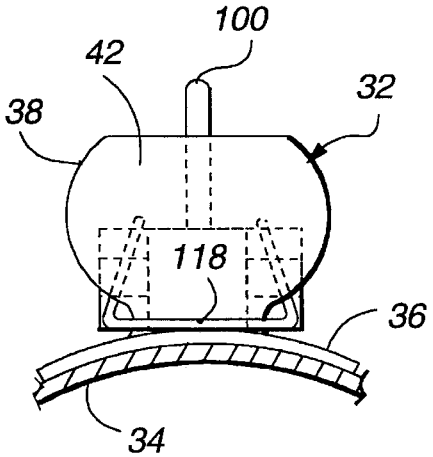
FIG. 6 a bottom plan view of the ring adapter assembly and fixed thumbrest shown in FIG. 1.

The bottom surface 76 of the lower base portion 74 of the assembled ring adapter 30 is positioned on the projection 38 of the fixed thumbrest 32 so that the eye portion 100 of the ring 94 extends away from the musical instrument 34, as shown in FIGS. 1, 3, 5 and 6. The closed end 118 of the spring steel U-shaped wire 114 is then pressed over the projection 38 of the fixed position thumbrest 32 so that the closed end of the wire contacts the lower surface 42 of the projection 38 at the relatively narrow neck portion 40, as shown best in FIGS. 4 and 6. Simultaneously, the rear face 50 of the main body is supported against the flange 36 of the thumbrest 32, as shown in FIG. 4. Once connected in this manner, the ring adapter 30 is thus situated so that a support device such as a neck strap or the monopod strut device disclosed in U.S. patent application Ser. No. 08/378,198 may be attached to the eye portion 100 of the ring 94. To ensure the ring adapter 30 can support the weight of the musical instrument 34, the screw 124 is tightened once the closed end 118 of the wire 114 is positioned about the neck portion 40 as shown in FIGS. 4 and 6. As the T-shaped cap 104 and the attached hook ends 120 of the wire 114 are raised relative to the fixed thumbrest 32, increased tension is placed on the wire and the cylindrical post 64 acts as a fulcrum which directs the force from the tension in the wire downwardly and away from the body of the musical instrument 34. The increased tension in the wire keeps the base 68 firmly seated on the projection 38 of the fixed thumbrest 32, and also keeps the ring adapter assembly 30 in a vertical position so that it does not come in contact with the body of the musical instrument 34 and thereby possibly scratch or mar the instrument when a support device is attached to the eye 100 of the ring 94.

An adhesive material 126 preferably bonds a resilient, compressible material 128 to the bottom surface 76 of the lower base portion 74 to provide a cushion which enhances the seating of the base 68 on the projection 38 of the thumbrest 32, as shown in FIGS. 1, 4, 8 and 9. The compressible material 128 is preferably non-abrasive to prevent scratching or marring the thumbrest when pressures are applied by turning the screw 124.

Figure 15:
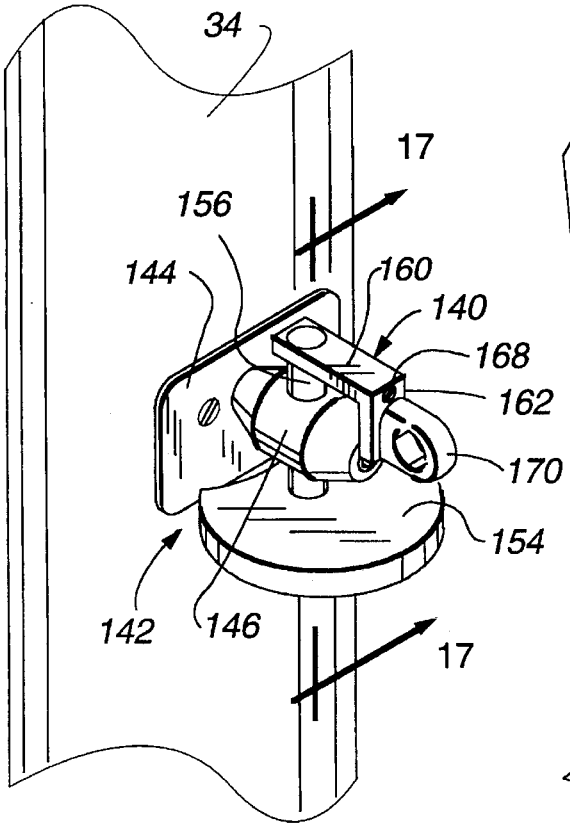
FIG. 15 is a perspective view of another embodiment of the ring adapter assembly of the present invention attached to an adjustable thumbrest of a musical instrument.
Figure 16:
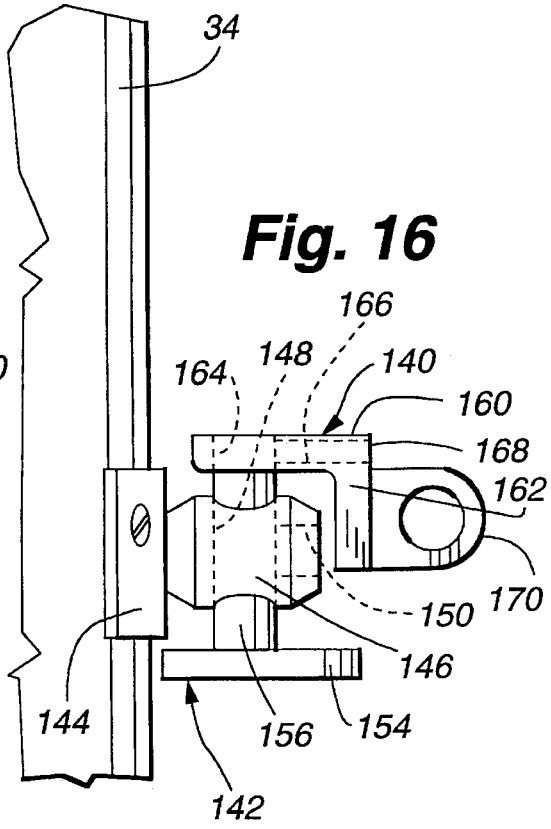
FIG. 16 is a side elevation view of the ring adapter assembly and adjustable thumbrest shown in FIG. 15.

An alternative embodiment 140 of a ring adapter for use with an adjustable thumbrest 142 is shown in FIGS. 15–19. The adjustable thumbrest shown in FIG. 15 includes a flange 144 fixed to the body of the musical instrument 34. A barrel-shaped portion 146 is permanently fixed to the flange 144 so that it extends toward the musician when the musical instrument is being played. A vertical hole 148 extends through the barrel shaped portion 146, as best shown in FIGS. 16 and 17. An end of the barrel shaped portion 146 opposite the flange 144 of the adjustable thumbrest includes a threaded horizontal hole 150 adapted to receive a set screw 152. The adjustable thumbrest 142 also includes a separate horizontal platform 154 similar in size and shape to the projection 38 of the fixed position thumbrest 32. A vertical post 156, sized to fit closely within the vertical hole 148, is fixed to one side of the horizontal platform 154. The vertical post 156 is preferably positioned within the vertical hole 148 as shown in FIGS. 15–17 so that the horizontal platform 154 is positioned below the fixed barrel-shaped portion 146. Once the vertical position of the horizontal platform 154 is set as desired by a musician, the set screw 152 is tightened to temporarily fix the position of the platform relative to the musical instrument 34, thereby allowing the musician to place his or her right thumb below the platform and support the weight of the instrument. By loosening the set screw 152 and sliding the vertical post 156 within the vertical hole 148, the position of the adjustable thumbrest 142 can be adjusted. Such adjustments are important when different musicians use the same musical instrument 34, or when a sole user of the instrument desires to obtain a different feel for the instrument by adjusting the thumbrest 142.

The alternative embodiment 140 of the ring adapter is substantially L-shaped, having a horizontal face 160 and a vertical face 162 attached at one end of the horizontal face. A vertical hole 164 extends completely through the horizontal face 160 at an end of the horizontal face opposite the attached vertical face 162. A threaded horizontal hole 166 extends through the horizontal face 160 from the vertical hole 164 to the end adjacent the vertical face 162. The vertical hole 164 is sized so that the horizontal face 160 will slide over the vertical post 156 of the adjustable thumbrest 142, and a set screw 168 within the threaded horizontal hole 166 may be tightened to contact the vertical post 156 and fix the position of the ring adapter 140 in relation to the adjustable thumbrest 142. A ring or eye 170 is fixed to the vertical face 162 of the ring adapter 140 to extend away from the horizontal face 160, as shown in FIGS. 15–17.

The vertical position of the eye 170 is at all times above the horizontal platform 154 of the adjustable thumbrest 142 so as to not interfere with the conventional hand position of the musician, and is preferably positioned adjacent the fixed barrel-shaped portion 146 of the adjustable thumbrest 142. Thus, when the thumbrest 142 is adjusted as shown in FIGS. 15–17, with a sufficient portion of the vertical post 156 extending above the barrel-shaped portion 146, the ring adapter 140 may be turned so that the vertical face 162 and eye 170 are below the horizontal face 160, thereby positioning the ring adapter 140 adjacent the barrel-shaped portion 146 of the adjustable thumbrest 142. However, if the horizontal platform 154 of the thumbrest 142 is adjusted lower, so that the length of the vertical post 156 extending above the barrel-shaped portion 148 is insufficient to connect the ring adapter 140, the ring adapter may be turned so that the vertical face 162 and eye 170 are above the horizontal face 160 as shown in FIGS. 18 and 19. Of course, in this configuration, the horizontal face 160 of the ring adapter 140 must be attached to the vertical post 156 of the thumbrest before the vertical post is fit within the vertical hole 148 and secured by the set screw 152. In either instance, the set screw 168 fixes the position of the eye 170 in relation to the vertical post 156, just as the set screw 152 fixes the position of the vertical post 156 relative to the fixed flange 144. Therefore, the position of the ring adapter 140 on the thumbrest 142 may be adjusted in a manner similar to adjusting the position of the thumbrest itself. The eye 170 of the ring adapter 140 thus provides an attachment point for support devices such as a neck strap or the monopod strut device disclosed in U.S. patent application Ser. No. 08/378,198.

Figure 20:
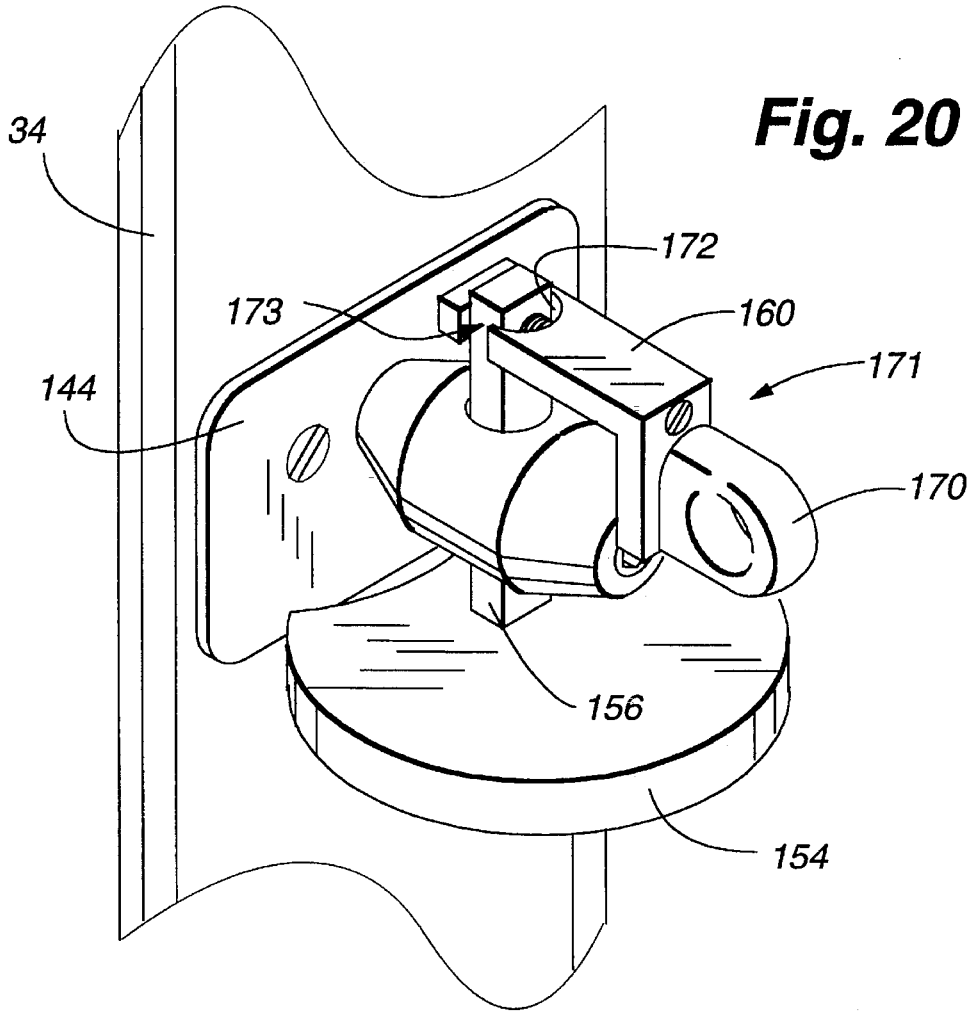
FIG. 20 is a perspective view of a further embodiment of the ring adapter assembly of the present invention attached to an adjustable thumbrest of a musical instrument.
Figure 21:
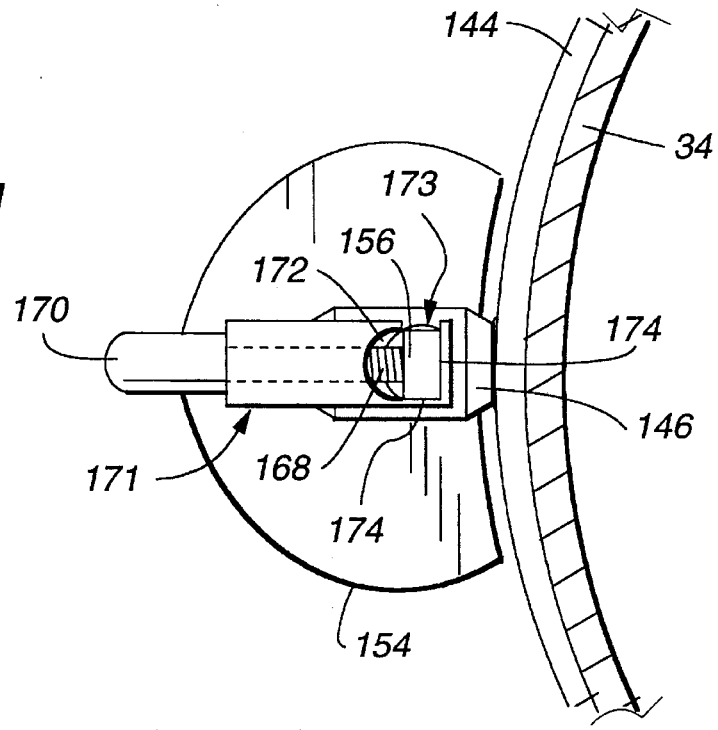
FIG. 21 is a top plan view of the ring adapter assembly and adjustable thumbrest shown in FIG. 20.

In some instances, such as with a clarinet, the vertical post 156 of the adjustable thumbrest 142 may have a rectangular cross section (FIGS. 20 and 21) as opposed to the round cross section shown in FIGS. 15–19. To ensure that the ring adapter will properly engage vertical posts having both round and rectangular cross sections, a further alternative embodiment 171 of the ring adapter is shown in FIGS. 20 and 21. The ring adapter 171 is very similar to the ring adapter 140, and elements that are unchanged between the ring adapters 140 and 171 will be referred to by identical reference numbers. For instance, the vertical face 162 and the eye 170 are the same between the two embodiments, and the only change is found on the horizontal face 160.

The horizontal face 160 of the ring adapter 171 includes the threaded horizontal hole 166 and set screw 168, as found in the ring adapter 140. However, the vertical hole 172 in the horizontal face of the ring adapter 171 differs slightly from the vertical hole 164 of the ring adapter 140. As shown in FIGS. 15–18, the vertical hole 164 is preferably round to receive the round cross section of the cylindrical vertical post 156. To ensure the ring adapter 171 can receive vertical posts of both round and rectangular cross section, the horizontal face of the ring adapter 171 defines a slot 173 to directly receive the vertical post 156 within the vertical hole 172, and the vertical hole 172 includes two flat sides 174 for firmly engaging the rectangular cross section of the vertical post 156. Once the rectangular post 156 is received within the slot 173 and is seated against the flat sides 174 within the vertical hole 172, the set screw 168 may be tightened to contact the vertical post 156 as described above. The slot 173 is not large enough to allow a vertical post of circular cross section to be pulled through the slot, and thus the connection of the ring adapter 171 to a cylindrical vertical post 156 is the same as with the ring adapter 140.

The monopod strut device disclosed in U.S. patent application Ser. No. 08/378,198 includes a monopod component which is adjustable in length and an attachment component connected to one end of the monopod component for attachment to a ring on a conventional thumbrest. The attachment component includes a stair-step shaped horizontal body having a slot in one end to receive the ring and a latch mechanism on top of the body which is pivotably actuated to engage the ring when it is received within the slot. The stair-step shape allows the slotted portion of the body which receives the ring to be positioned above the top surface of the thumbrest opposite the surface where the musician's thumb supports the thumbrest. Positioning the attachment component body in this manner allows the latch mechanism to transfer the weight of the instrument to the attachment component and simultaneously prevents any downward force on the body of the attachment component from being applied directly to the latch mechanism due to the support of the thumbrest beneath the attachment component.

However, the attachment components disclosed in U.S. patent application Ser. No. 08/378,198 will not work effectively with the ring adapters of the present invention due to the fact that the eye portions 100 and 170 of the ring adapters 30 and 140, respectively, are not attached directly to the thumbrests themselves but rather extend above and, in some cases, in front of the thumbrests. Therefore, an attachment component of a monopod strut device such as that shown in U.S. patent application Ser. No. 08/378,198 will not be supported on the thumbrest itself and thus does not prevent a downward force applied directly to the body of the attachment component from applying a reactive upward force to the latch mechanism on top of the attachment component. Such an upward force can bend and distort the top-mounted latch mechanism to such a degree as to render the attachment component of limited value.

An alternative attachment component 175 for the monopod strut device disclosed in U.S. patent application Ser. No. 08/378,198, overcomes these disadvantages, as is apparent from FIGS. 10–14 and 19. The main difference between the attachment component 175 and the previously disclosed attachment component is that a latch mechanism 176 is placed within a body 178 of the attachment component 175 as opposed to being located atop the body. Additionally, the body 178 of the attachment component 175 does not include a stair-step shape since no portion of the body 178 is supported on the thumbrest itself. Rather, the body 178 is freely attached to the eye of the ring adapters 30 and 140.

Figure 14:
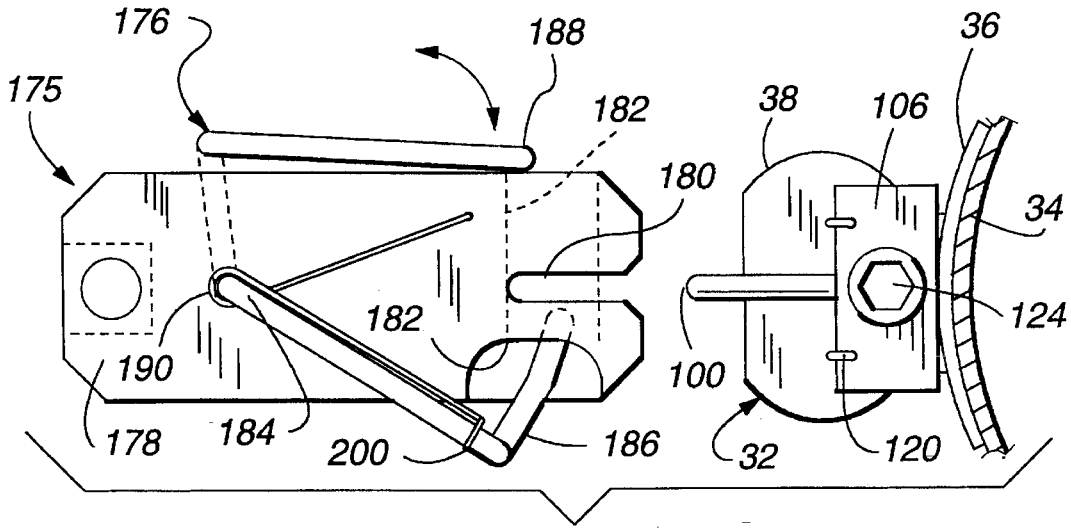
FIG. 14 is a top plan view of the attachment component shown in FIG. 10, and a top plan view of the ring adapter assembly and fixed thumbrest shown in FIG. 1, showing the attachment component in a position to receive the ring adapter assembly.

Except as noted above, the construction of the attachment component 175 is similar to that shown in U.S. patent application Ser. No. 08/378,198. One end of the body 178 defines a slot 180 which receives the eye of either the ring adapter 30 (FIG. 14) or the ring adapter 140 (FIG. 19). A transverse slot 182 is also formed in the same end of the body 178 and intersects the slot 180 as shown in FIGS. 12–14. The latch mechanism 176 includes a single rigid shaft 184 which is inserted into a hole formed in the body 178 and bent into an appropriate configuration. An upper portion (as shown) of the shaft 184 is bent to form a depending hook end 186 which resides within the transverse slot and extends through the eye of the ring adapters 30 and 140 when the latch mechanism 176 is connected to the thumbrests 32 and 142, respectively. A middle portion of the shaft 184 pivots within the hole in the body 178 when the latch mechanism 176 operates. A lower portion of the shaft 184 is bent to form an actuating handle 188. An outer portion of the actuating handle 188 normally extends to the side of the body 178, as shown in FIGS. 10–12. In this position, the hook end 186 extends through the eye 170 of the ring adapter 140, as shown in FIG. 19. When the outer portion of the actuating handle 188 is pivoted to a position adjacent to the body 178, the hook end 186 is withdrawn from the eye so as to release the connection of the attachment component 175, as shown in FIG. 14 with respect to the eye 100 of the ring adapter 30.

A coil spring 190 is connected around the middle portion of the shaft 184 at a location above the upper surface of the body 178 and before the shaft 184 bends from middle portion into the upper portion which forms the hook end 186. One end 192 of the spring 190 extends from the coils 194 to a hole 196 formed in the body 178. The other end 198 of the spring 190 extends from the coils 194 to the upper portion of the shaft 184 at a location short of the depending hook end 186. The end 198 of the spring 190 is connected in a loop 200 around the shaft 184.

The coils 194 of the spring 190 bias the ends 192 and 198 toward one another under normal circumstances to pivot the shaft 184 of the latch mechanism 176 counterclockwise as shown in FIGS. 10–14 and 19. The normal spring bias moves the latch mechanism 176 to a normally closed or latched position. Movement of the actuating handle 188 against the body 178, as shown in FIG. 14, requires the musician to apply force to overcome the bias of the spring 190. So long as the musician applies this force to the actuating handle 188, the latch mechanism 176 is in an open or unlatched position. When the actuating handle 188 is released, the spring 190 moves the latch mechanism to the closed or latched position. Thus, positive effort is required by the musician to connect and disconnect the attachment component 175 of the monopod strut device to the ring adapters 30 and 140. The normal bias of the spring 190 keeps the attachment component 175 connected to the eyes of the ring adapters 30 and 140 when the musical instrument 34 is being played.

The transverse slot 182 acts to capture the hook end 186 of the latch mechanism 176 when the latch mechanism 176 is in the closed or latched position. Capturing the hook end 186 in this manner prevents any downward force applied to the body 178 of the attachment component 175 from bending the hook end 186 upwards when the hook end is attached through the eye of the ring adapters 30 and 140. Since capturing the hook end 186 will prevent the hook end from being bent either up or down, the alternative attachment component 175 will function equally well with both the ring adapters of the present invention and a thumbrest having a permanent eye or attachment ring, and thus the attachment component 175 could be easily interchanged with the attachment component disclosed in U.S. patent application Ser. No. 08/378,198.

In summary, the ring adapters of the present invention provide a releasable yet sturdy attachment ring for both fixed and adjustable thumbrests which do not include their own permanent attachment rings. A need for such releasable attachment rings is evident where the weight of certain woodwind musical instruments must be fully supported by the musician placing his or her thumb underneath the thumbrests. The ring adapters provide an attachment point for a variety of support devices. For instance, if the musician plays the musical instrument while standing or marching, a neck strap or a chest support may be attached to the eyes of the different ring adapters disclosed. Alternatively, if the musician plays in a seated position, a monopod strut device of the type disclosed in U.S. patent application Ser. No. 08/378,198, having a modified attachment component as described above, may be attached to the eyes of the different ring adapters to support the weight of the musical instrument on the musician's chair. Additionally, the above described attachment component 175 may also be used on the monopod strut device in conjunction with the fixed thumbrest/attachment ring combination disclosed in U.S. patent application Ser. No. 08/378,198.

Presently preferred embodiments of the present invention and many of its improvements have been described with a degree of particularity. This description is of preferred examples and benefits for implementing the invention. The scope of the invention should not be limited by this description, but instead is defined by the scope of the following claims.

The invention claimed is:

1. A ring adapter assembly for a musical instrument having a thumbrest which includes a horizontal projection extending outward from the instrument toward a musician and under which a thumb of the musician is conventionally placed, said assembly comprising:

a body;

attachment apparatus for connecting the body to the thumbrest without interfering with placement and position of the musician's thumb under the horizontal projection; and an eye fixed to the body at a position above the horizontal projection of the thumbrest.

2. A ring adapter assembly as defined in claim 1, wherein the position of the horizontal projection is fixed in relation to the musical instrument, and wherein the body further includes:

a base having a bottom surface seated upon a top surface of the horizontal projection.

3. A ring adapter assembly as defined in claim 2, wherein the body further comprises:

a resilient, compressible surface bonded to the bottom surface of the base and adapted to be seated on the horizontal projection.

4. A ring adapter assembly as defined in claim 1, wherein a vertical post is fixed to a top surface of the horizontal projection of the thumbrest and a receptacle is fixed to the musical instrument to receive the vertical post and adjustably fix the position of the horizontal projection in relation to the musical instrument, and wherein:

the body further comprises an elongated horizontal surface defining a vertical opening at one end to receive the vertical post of the thumbrest and allow the horizontal surface to move along the vertical post; and the attachment apparatus includes movement limiting means to fix the location of the horizontal surface relative to the vertical post.

5. A ring adapter assembly as defined in claim 4, wherein:

the horizontal surface further defines a threaded horizontal opening; and the movement limiting means comprises a set screw extending through the threaded horizontal opening to contact the vertical post.

6. A ring adapter assembly as defined in claim 4, wherein:

the body further comprises a vertical surface attached to an end of the horizontal surface opposite the vertical opening; and the eye is fixed to the vertical surface.

7. A ring adapter assembly as defined in claim 6, wherein the vertical surface and the eye extend below the horizontal surface.

8. A ring adapter assembly as defined in claim 6, wherein the vertical surface and the eye extend above the horizontal surface.

9. A ring adapter assembly as defined in claim 6, wherein:

the horizontal surface is fixed to the vertical post at a location above the receptacle; and the vertical surface and the eye extend below the horizontal surface.

10. A ring adapter assembly as defined in claim 6, wherein:

the horizontal surface is fixed to the vertical post at a location below the receptacle; and the vertical surface and the eye extend above the horizontal surface.

11. A ring adapter assembly as defined in claim 1, in combination with:

an attachment component for connecting the ring adapter assembly to a support device for the musical instrument, said attachment component comprising:

an elongated body adapted to be connected to the support device; and a connector pivotably connected to the elongated body, said connector pivotable between an open position and a closed position to engage the eye and connect the elongated body to the eye without interfering with the conventional placement and position of the musician's thumb on the thumbrest.

12. A ring adapter assembly and attachment component combination as defined in claim 15, wherein the connector includes:

a hook; and an actuating handle connected to the hook to pivot the hook to the closed position through the eye and and to pivot the hook to the open position and withdraw the hook from the eye.

13. A ring adapter assembly and attachment component combination as defined in claim 12, wherein the elongated body further includes:

a longitudinal slot formed at one end of the elongated body to receive the eye; and a transverse slot formed adjacent the one end of the elongated body to capture the hook as the actuating handle moves the hook across the longitudinal slot.

14. A ring adapter assembly and attachment component combination as defined in claim 13, wherein the connector further comprises:

a biasing device connected between the hook and the elongated body to bias the hook into a position within the transverse slot and extending across the longitudinal slot.

15. A ring adapter assembly and attachment component combination as defined in claim 12, wherein the elongated body further includes:

a longitudinal slot formed at one end of the elongated body to receive the eye.

16. A ring adapter assembly and attachment component combination as defined in claim 15, wherein the elongated body further includes:

a transverse slot formed adjacent the one end of the elongated body to capture the hook as the actuating handle moves the hook across the longitudinal slot.

* * * * *